US006316876B1

(12) United States Patent
Tanabe

(10) Patent No.: US 6,316,876 B1
(45) Date of Patent: Nov. 13, 2001

(54) HIGH GRADIENT, COMPACT, STANDING WAVE LINEAR ACCELERATOR STRUCTURE

(76) Inventor: Eiji Tanabe, 20326 Via Volante, Cupertino, CA (US) 95014

( * ) Notice: Subject to any disclaimer, the term of this patent is extended or adjusted under 35 U.S.C. 154(b) by 0 days.

(21) Appl. No.: 09/375,752

(22) Filed: Aug. 18, 1999

Related U.S. Application Data

(60) Provisional application No. 60/097,162, filed on Aug. 19, 1998.

(51) Int. Cl.[7] ..... H05H 9/04; H05H 7/18

(52) U.S. Cl. ..... 315/5.41; 315/5.42; 315/5.39; 315/5.51; 315/5.52; 315/505

(58) Field of Search ..... 315/505, 5.41, 315/5.39, 5.51, 5.52, 5.42

(56) References Cited

U.S. PATENT DOCUMENTS 4,400,650 * 8/1983 Giebeler, Jr. ..... 315/5.41
5,039,910 * 8/1991 Moriguchi et al. ..... 315/5.41
5,381,072 * 1/1995 Tanabe ..... 315/5.41

FOREIGN PATENT DOCUMENTS

0558296 A * 9/1993 (EP) ..... H05H/7/18

* cited by examiner

*Primary Examiner*—Bruce Anderson
*Assistant Examiner*—Nikita Wells
(74) *Attorney, Agent, or Firm*—Moser, Patterson & Sheridan, LLP

(57) ABSTRACT

A standing wave accelerator structure that has both inline coupling cavities and side coupling cavities combined into one structure. Additionally, the invention uses a prebunching (re-entrant) cavity, excited electrically or magnetically, through apertures between a first accelerating cavity and the prebunching cavity.

8 Claims, 3 Drawing Sheets

HIGH GRADIENT, COMPACT, STANDING WAVE LINEAR ACCELERATOR STRUCTURE

This patent application claims benefit of U.S. provisional patent application Ser. No. 60/097,162, filed Aug. 19, 1998, the disclosure of which is incorporated herein by reference.

BACKGROUND OF THE INVENTION

FIG. 1 depicts a side-coupled standing-wave linear accelerator. This type of accelerator has been widely used in medical and industrial applications because it offers very high shunt impedance and operational stability. In order to increase shunt impedance per unit length, most of these accelerators use solely $\pi/2$ operational mode in the single section standing wave accelerator structure. For instance, the invention of the side coupled structure permitted elimination of a bend magnet and use of an extremely short in-line accelerator in a 360° isocentric gantry for low energy radiation therapy machines. In this short standing wave linear accelerator structure, electrons 4 which are generated in the cathode 2 of the electron gun 1, are accelerated by DC voltage applied between the cathode 2 and the anode 7 and injected directly into the first cavity 3.

Since the applied voltage between the cathode 2 and anode 7 is only 10 to 30 kev, the velocities of these injected electrons are much slower than the velocity of light. As a result, the trajectories of the injected electrons depend strongly on the accelerating microwave electric field within the first cavity 3. The microwave power fed through the waveguide 25 generates an accelerating microwave electric field within the accelerating cavities 8. The microwave power is transmitted through apertures 5 of the coupling cavities 6 where accelerating cavities and coupling cavities are magnetically coupled through the aperture 5.

In order to efficiently couple these cavities magnetically, these coupling apertures are positioned away from the beam center where the electrons are accelerated. Due to the nature of these non-axisymmetric coupling apertures, the resultant accelerating electric field tends to offset from the beam centerline. These offsets may not be significant for the acceleration of the electrons, which have a velocity very close to the velocity of light, because the longitudinal momentum of high velocity electrons are much larger than the transverse momentum due to space charge affect and transverse accelerating fields. For the electrons injected initially into the first cavity 3, the trajectories will depend on the accelerating field within its cavity where coupling apertures are off-centered. Axisymmetric cavities excited with non-axisymmetric apertures tend to generate a non-axisymmetric electric field. As a result, the electrons accelerated in the first cavity tend to have non-axisymmetric electron distributions for a standing wave linear accelerator which uses only off-center magnetic coupling. This non-axisymmetric electron beam distribution generates non-symmetric Bremsstrahlung x-rays at the target 9 where normally very thin, but heavy metal (high atomic number)—such as tungsten—is imbedded into a water-cooled copper heat sink 10.

Another problem with this structure is that about two-thirds of the injected electrons are not accelerated in the first cavity because they are excited sinusoidally at the microwave frequency. Some of the electrons, which are not accepted in the first cavity, are often decelerated back to the electron gun, called back-bombardment, and damage the cathode of the electron gun.

Therefore, there is a need in the art for a linear accelerator having improved electron acceleration characteristics for compact side-coupled standing wave accelerators.

SUMMARY OF THE INVENTION

The disadvantages associated with the prior art are overcome by a standing wave accelerator structure that has both inline coupling cavities and side coupling cavities combined into one structure. Additionally, the invention uses a prebunching (re-entrant) cavity, excited electrically or magnetically, through apertures between a first accelerating cavity and the prebunching cavity.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
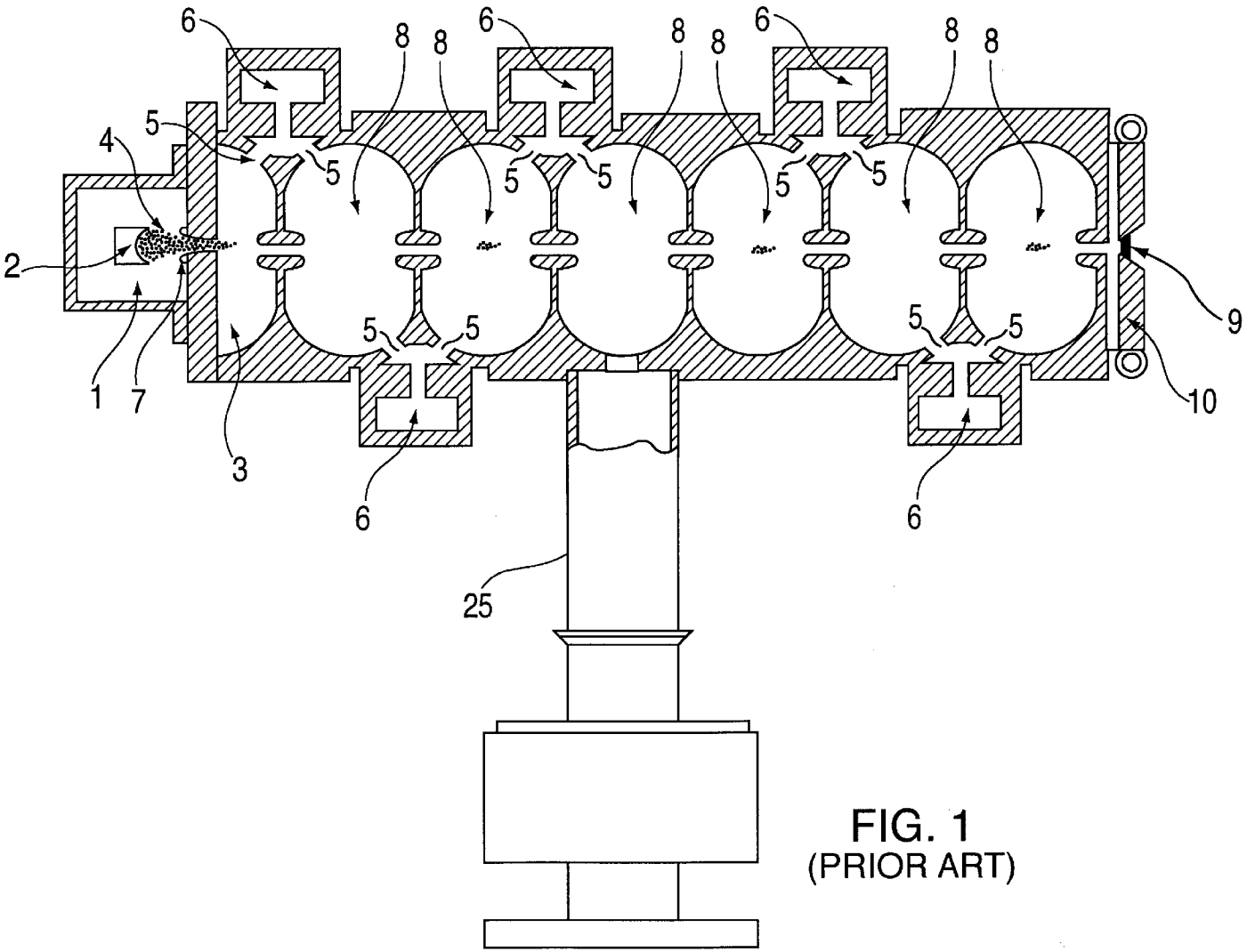
FIG. 1 (PRIOR ART)
FIG. 1 depicts a cross-sectional view of a side coupled, standing wave linear accelerator of a the prior art.
Figure 2:
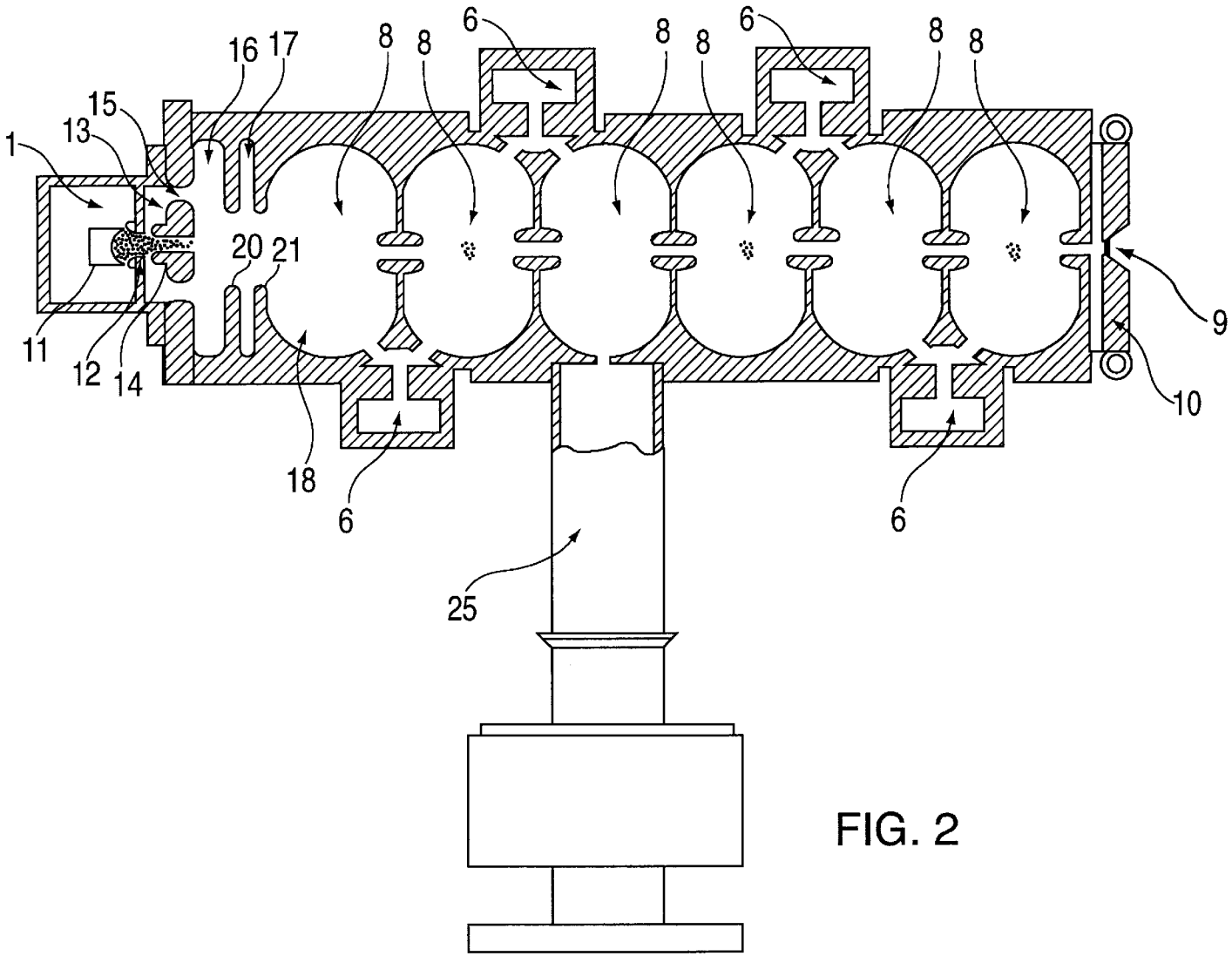
FIG. 2 depicts a cross-sectional view of a high gradient side coupled, standing wave linear accelerator of the present invention.

The disadvantages associated with prior art side-coupled standing wave linear accelerator structures can be eliminated by the structure shown in FIG. 2. The excited electrons on the cathode 11 (within electron gun 1) are accelerated by the voltage applied between the cathode 11 and an additional anode 12. The electrons are injected first into a relatively small re-entrant cavity 13, which is formed between an additional anode 12 and the original anode 14. The diameter of the re-entrant cavity 13 is about half the diameter of cavities 16, 17, 18 and 8. The electron velocity is modulated slightly by the microwave field leaked through the apertures 15 axisymmetrically placed between first accelerating cavity and the re-entrant cavity 13 that is placed between the electron gun 1 and the first cavity 16. This low level microwave power coupling can be obtained through either electric or magnetic axisymmetric coupling apertures 15. Alternatively, low level microwave power can be fed to the re-entrant cavity 13 through a coaxial cable and coupling loop antenna. As a result, while the electron is traveling through the beam aperture 14, electrons are prebunched and injected into the first cavity 16. By choosing an appropriate gun voltage (approximately 10–15 kV), drift distance (about 16 mm), and modulating power level (about 5 kW), almost all prebunched electrons are accepted into the first accelerator cavity 16.

Figure 5:
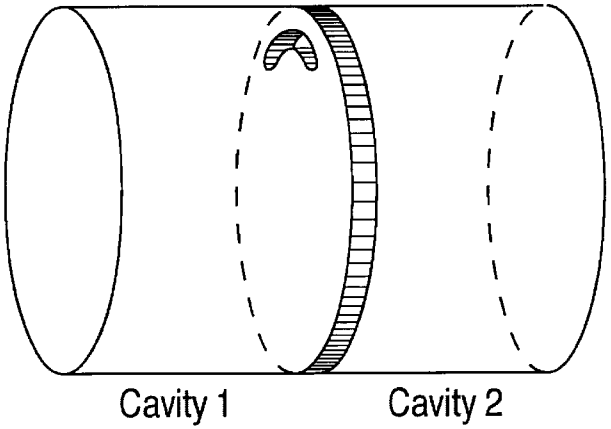
FIG. 5 depicts a non-axisymmetric coupling aperture.
Figure 6:
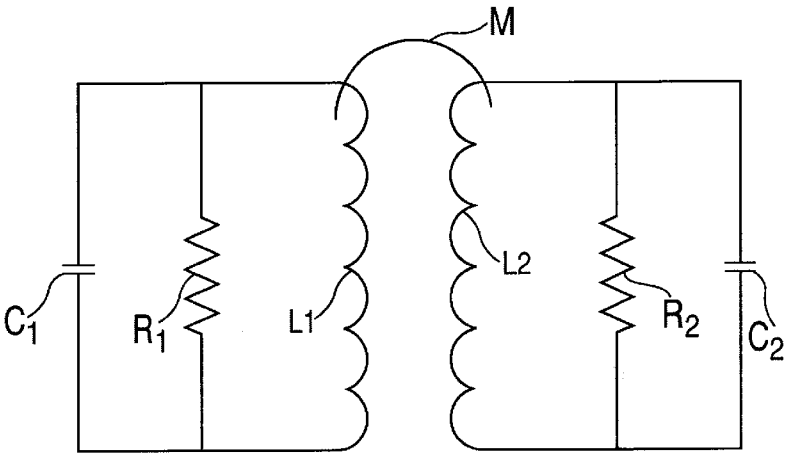
FIG. 6 depicts an equivalent circuit representation of a non-axisymmetric coupling aperture.
Figure 3:
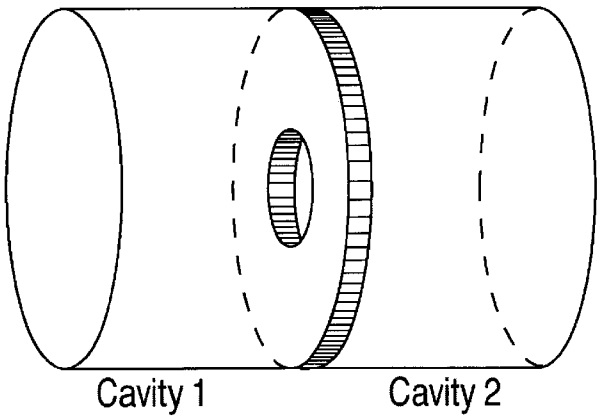
FIG. 3 depicts an axisymmetric coupling aperture.
Figure 4:
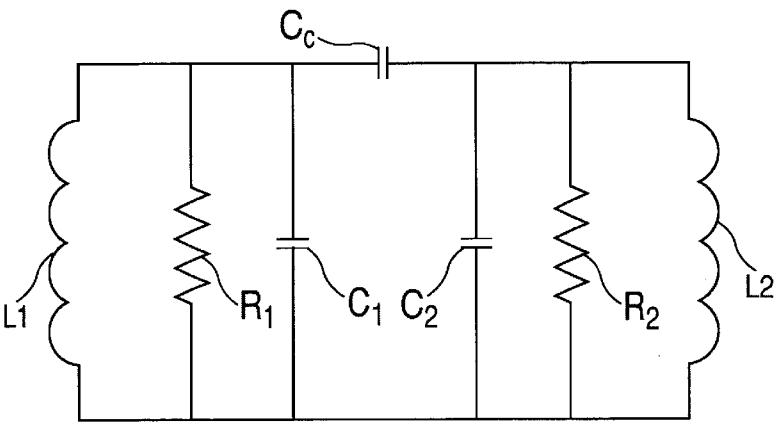
FIG. 4 depicts an equivalent circuit representation of an axisymmetric coupling aperture.

Also, the first cavity 16 is coupled with the accelerating cavity 18 through a disk-shaped coupling cavity 17 where microwave power is coupled electrically through electrical coupling apertures 20 and 21. The advantage of using electrical coupling is that the coupling aperture can be axisymmetric as showing in FIG. 3 (FIG. 4 depicts an equivalent circuit representation of the aperture of FIG. 3) instead of a non-axisymmetric coupling aperture as shown in FIG. 5 (FIG. 6 depicts an equivalent circuit representation of the aperture of FIG. 5). As a result, the slower bunched electrons injected through the beam aperture 14 are axisymmetrically accelerated with a high accelerating microwave electric field in the first cavity 16. While these pre-accelerated electrons are further bunched through drifting in the cavity 17 where no accelerating field existed, they are injected into a main accelerating cavity 18 where electron energy may reach above 1Million Volts. At that time, the longitudinal momentum is high enough so that the electron will not be affected significantly by nonsymmetrical accelerating fields which the rest of the accelerator cavity has.

In this way the accelerator structure of the present invention offers the following characteristics:

1. The accelerated electrons will maintain axisymmetric charge distribution while pre-acceleration is accomplished by axisymmetric accelerating field obtained by electrical aperture coupling between the first accelerating cavity and the second main accelerating cavity.
2. Both electrical and magnetic couplings are mixed within one structure in order to utilize both advantages.
3. The generated electrons can be prebunched within the tiny prebuncher (re-entrant) cavity before entering into the first accelerating cavity. The prebuncher cavity can be axisymmetrically excited magnetically or electrically through very small apertures between the first accelerating cavity and the prebunching tiny cavity.
4. The accelerator utilizes different operational modes, such as $\pi/2$ and $\pi$ mode, within a single section standing wave structure.

Although various embodiments which incorporate the teachings of the present invention have been shown and described in detail herein, those skilled in the art can readily devise many other varied embodiments that still incorporate these teachings. For instance, the invention can be readily utilized for longer high energy dual photon accelerators where low energy, high current beam must be transported through a longer accelerating structure. Another application is for the high gradient, higher energy RF gun where beam emittance and symmetry are very important.

What is claimed is:

1. A linear accelerator comprising:

a cathode;

a re-entrant cavity; and a plurality of accelerating cavities, where the re-entrant cavity is located between the cathode and the plurality of accelerating cavities.

2. The linear accelerator of claim 1 wherein said re-entrant cavity has a diameter that is smaller than a diameter of said plurality of accelerating cavities.

3. The linear accelerator of claim 1 wherein said re-entrant cavity is defined by a first anode and a second anode.

4. The linear accelerator of claim 1 wherein said plurality of accelerating cavities comprises a first accelerating cavity, coupled to a said re-entrant cavity through an axisymmetric aperture.

5. The linear accelerator of claim 4 wherein said axisymmetric aperture are either electric or magnetic coupling apertures.

6. The linear accelerator of claim 1 wherein said plurality of accelerating cavities comprise a first acceleration cavity, a disk-shaped coupling cavity, and a plurality of accelerating cavities.

7. The linear accelerator of claim 1 wherein electrons from the cathode are prebunched in the re-entrant cavity.

8. The linear accelerator of claim 7 wherein the electrons are prebunched using either electric or magnetic coupling.

* * * * *

UNITED STATES PATENT AND TRADEMARK OFFICE

CERTIFICATE OF CORRECTION

PATENT NO. : 6,316,876 B1
DATED : November 13, 2001
INVENTOR(S) : Eiji Tanabe

It is certified that error appears in the above-identified patent and that said Letters Patent is hereby corrected as shown below:

Column 1,
Line 27, please replace “kev” with -- keV --.

Column 21,
Line 21, please delete “a”.

Column 3,
Line 1, please replace “showing” with -- shown --.
Line 12, please replace “1Million” with -- 1 Million --.

Signed and Sealed this

Thirty-first Day of December, 2002

JAMES E. ROGAN
*Director of the United States Patent and Trademark Office*